US009724813B2

(12) United States Patent
Pettersson

(10) Patent No.: US 9,724,813 B2
(45) Date of Patent: Aug. 8, 2017

(54) DEVICE FOR ROCK AND-CONCRETE MACHINING

(75) Inventor: Maria Pettersson, Stora Mellösa (SE)

(73) Assignee: Atlas Copco Rock Drills AB, Orebro (SE)

( * ) Notice: Subject to any disclaimer, the term of this patent is extended or adjusted under 35 U.S.C. 154(b) by 891 days.

(21) Appl. No.: 13/261,717

(22) PCT Filed: Apr. 3, 2012

(86) PCT No.: PCT/SE2012/050365

§ 371 (c)(1),
(2), (4) Date: Aug. 22, 2013

(87) PCT Pub. No.: WO2012/138287

PCT Pub. Date: Oct. 11, 2012

(65) Prior Publication Data

US 2013/0327555 A1 Dec. 12, 2013

(30) Foreign Application Priority Data

Apr. 5, 2011 (SE) ..... 1100252-4

(51) Int. Cl.
*B25D 9/12* (2006.01)
*E21B 1/02* (2006.01)
(Continued)

(52) U.S. Cl.
CPC ..... *B25D 9/125* (2013.01); *B25D 9/04* (2013.01); *B25D 9/12* (2013.01); *B25D 9/145* (2013.01); *B25D 9/18* (2013.01); *E21B 1/02* (2013.01)

(58) Field of Classification Search
CPC ... B25D 9/12; B25D 9/18; B25D 9/04; B25D 9/14; B25D 9/125; B25D 9/145;
(Continued)

(56) References Cited

U.S. PATENT DOCUMENTS 1,553,598 A 9/1925 Cooley
1,748,953 A 3/1930 Greve
(Continued)

FOREIGN PATENT DOCUMENTS

FR 701725 3/1931
FR 716440 12/1931
(Continued)

*Primary Examiner* — Hemant M Desai
*Assistant Examiner* — Mary Hibbert
(74) *Attorney, Agent, or Firm* — Mark P. Stone

(57) ABSTRACT

The invention concerns a hydraulic striking tool for application in rock and/or concrete cutting equipment containing a machine housing (100;200) with a cylinder (115;215) with a moveably mounted piston (145;245) which during operation performs a repetitive forward and backward movement relative to the machine housing (100;200) and directly or indirectly strike a rock and/or concrete cutting tool (155; 255), and where the piston (145;245) includes a driving part (165;265) which separates a first (120;220) and a second (105;221) driving chamber formed between the piston (145; 245) and the machine housing (100;200) and where these driving chambers are arranged to include a pressurized working fluid during operation. The total volume V of the first and second driving chambers is inversely proportional dimensioned to the square of a for the striking tool recommended maximal pressure p, as well as proportional, by a proportionality constant k within the interval 5.3-21.0, to the product of the pistons energy E during the strike against the tool and compression module β of the working fluid.

20 Claims, 4 Drawing Sheets

(51) Int. Cl.

| | |
|---|---|
| ***B25D 9/04*** | (2006.01) |
| ***B25D 9/14*** | (2006.01) |
| ***B25D 9/18*** | (2006.01) |

(58) Field of Classification Search

CPC ..... E21B 1/02; E21B 1/29; E21B 1/24; E21B 4/14; E21B 21/12

USPC ..... 173/200

See application file for complete search history.

(56) References Cited

U.S. PATENT DOCUMENTS

| | | | | | |
|---|---|---|---|---|---|
| 1,849,208 | A | | 3/1932 | Slatcher | |
| 3,444,937 | A | | 5/1969 | Warrington et al. | |
| 3,620,312 | A | | 11/1971 | Krasnoff | |
| 4,174,010 | A | | 11/1979 | Hibbard | |
| 4,282,937 | A | | 8/1981 | Hibbard | |
| 4,550,785 | A | * | 11/1985 | Hibbard | B25D 9/12 173/206 |
| 4,648,467 | A | | 3/1987 | Ahtola et al. | |
| 4,921,056 | A | | 5/1990 | Ennis | |
| 5,115,875 | A | | 5/1992 | Ennis | |
| 5,311,948 | A | | 5/1994 | Kimberlin | |
| 5,944,117 | A | | 8/1999 | Burkholder et al. | |

FOREIGN PATENT DOCUMENTS

| | | |
|---|---|---|
| GB | 1396307 | 6/1975 |
| GB | 1554598 | 10/1979 |
| RU | 2013541 | 5/1994 |
| SU | 1068591 | 1/1984 |
| WO | WO 2008/095073 | 8/2008 |

* cited by examiner

Modulus of compressibility for oil-air mixture

βbt=ytβt

DEVICE FOR ROCK AND-CONCRETE MACHINING

TECHNICAL AREA

The present invention concerns hydraulic impact mechanisms of the type known as "slideless" or "valveless" to be used in equipment for machining at least one of rock and concrete, and equipment for drilling and breaking comprising such impact mechanisms.

BACKGROUND

Equipment for use in rock or concrete machining is available in variants with percussion, rotation, and percussion with simultaneous rotation. It is well-known that the impact mechanisms that are components of such equipment are driven hydraulically. A hammer piston, mounted to move within a cylinder bore in a machine housing, is then subject to alternating pressure such that a reciprocating motion is achieved for the hammer piston in the cylinder bore. The alternating pressure is most often obtained through a separate switch-over valve, normally of sliding type and controlled by the position of the hammer piston in the cylinder bore, alternately connecting at least one of two drive chambers, formed between the hammer piston and the cylinder bore, to a line in the machine housing with driving fluid, normally hydraulic fluid, under pressure, and to a drainage line for driving fluid in the machine housing. In this way a periodically alternating pressure arises that has a periodicity corresponding to the impact frequency of the impact mechanism.

It is also known, and has been for more than 30 years, to manufacture slideless hydraulic impact mechanisms, also known sometimes as "valveless" mechanisms. Instead of having a separate switch-over valve, the hammer pistons in valveless impact mechanisms perform also the work of the switch-over valve by opening and closing the supply and drainage of driving fluid under pressure during the motion of the piston in the cylinder bore in a manner that gives an alternating pressure according to the above description in at least one of two drive chambers separated by a driving part of the hammer piston. A precondition for thus to work is that channels, arranged in the machine housing for the pressurisation and drainage of a chamber, open out into the cylinder bore such that the openings are separated in such a manner that direct short-circuited connection between the supply channel and the drainage channel does not arise at any position during the reciprocating motion of the piston. The connection between the supply channel and the drainage channel is normally present only through the gap seal that is formed between the driving part and the cylinder bore. Otherwise, major losses would arise, since the driving fluid would be allowed to pass directly from the high-pressure pump to a tank, without any useful work being carried out.

In order for the piston to continue its motion from the moment at which a channel for drainage of a drive chamber is closed until the moment at which a channel for the pressurisation of the same drive chamber opens, or vice versa, it is required that the pressure in the drive chamber change slowly as a consequence of a change in volume. This may take place through the volume of at least one drive chamber being made large relative to what is normal for traditional impact mechanisms of sliding type. It is necessary that the volume be large since the hydraulic fluid that is normally used has a low compressibility. We define the compressibility $\kappa$ as the ratio between the relative change in volume and the change in pressure: $\kappa=(dV/V)/dP$. It is, however, more common to use the modulus of compressibility, $\beta$, as a measure of compressibility. This is the inverse of the compressibility as defined above, i.e. $\beta=dP/(dV/V)$. The units of the modulus of compressibility are Pascal. The definitions given above will be used throughout this document.

U.S. Pat. No. 4,282,937 reveals a valveless hydraulic impact mechanism with two drive chambers, where the pressure alternates in both of these chambers. Both drive chambers have a large effective volume through them being placed in permanent connection with volumes that lie close to the cylinder bore. One disadvantage of the prior art technology revealed in this way is that it has turned out to give a surprisingly low efficiency, given that one mobile part has been removed compared with conventional impact mechanisms with a switch-over valve. In this document we define "efficiency", unless otherwise stated, as the hydraulic efficiency, i.e. the impact power of the piston divided by the power supplied to the hydraulic pump.

SU 1068591 A reveals a valveless hydraulic impact mechanism according to a second principle, namely that of alternating pressure in the upper drive chamber and a constant pressure in the lower, i.e. the chamber that is closest to the connection of the tool. What is aspired to here is improved efficiency through the introduction of a non-linear accumulator system working directly against the chamber in which the pressure alternates. This is shown with two separate gas accumulators, where one of these has a high charging pressure and the other has a low charging pressure.

One disadvantage of being compelled to introduce accumulators that act directly at a chamber where the pressure alternates at the impact frequency between full impact mechanism pressure and a low return pressure during operation is that the service interval becomes shorter due to the moving parts in the accumulators being subject to heavy wear.

Purpose of the Invention and its Most Important Distinguishing Features

One purpose of the present invention is to demonstrate a design of a valveless hydraulic impact mechanism that offers the opportunity of improving the efficiency without at the same time reducing the service interval. This is achieved in the manner that is described in the independent claims. Further advantageous embodiments are described in the non-independent claims.

We define the effective volume of the drive chambers as the sum of the drive chamber volumes that have an alternating pressure during one stroke cycle, including volumes that are in continuous connection with one and the same drive chamber during a complete stroke cycle. It has proved to be the case that the effective volume of the drive chambers, according to the definition given above, is of crucial significance for the efficiency of the impact mechanism with respect to valveless impact mechanisms. There are, of course, many factors that influence the efficiency, such as play and the length of gap seals, friction in bearings, etc. It is not possible, however, to achieve the desired efficiency without a correctly adapted effective volume of the drive chambers, no matter how such play and bearings are designed.

Factors that influence the optimal effective volume of the drive chambers with respect to efficiency are: the impact mechanism pressure used, the compressibility of the driving medium and the energy of the piston in its impact against the tool or against a part that interacts with the tool. To be more precise, the effective volume of the drive chambers is influenced in inverse proportion to the square of the impact mechanism pressure and proportionally to the product of the effective modulus of compressibility of the driving medium and the energy of the hammer piston when it impacts the tool or a part that interacts with the tool, such as the part known as an "adapter".

The relationship can be expressed by the equation: $V=k*\beta*E/p^2$, where V is the effective drive chamber volume (by which we mean the sum of the volumes of the two drive chambers, including volumes that are in continuous connection with one and the same drive chamber during a complete stroke cycle). In the case in which alternating pressure is present in only one of the drive chambers, the volume of this chamber is normally totally dominating in comparison with that of the chamber that has a constant pressure. It then becomes possible to regard the effective drive chamber volume as the volume solely of the drive chamber that has alternating pressure together with the volume that is continuously connected to this. β in the equation constitutes the effective modulus of compressibility of the driving medium as it has been previously defined. If the driving medium consists of several components each of them having an individual compressibility, the effective modulus of compressibility is calculated as the resultant ratio between the change in pressure and the relative change in volume. FIG. 3 presents values of β for hydraulic fluids with different levels of air content. FIG. 3 has been taken from a collection of equations in hydraulic and pneumatic engineering, and thus constitutes prior art technology. It will be apparent to one skilled in the arts that $\beta=1500+7.5p$ MPa when the air content of the fluid is zero. In the case in which gas accumulators are directly connected to the effective volumes, as is described in, for example, SU 1068591 A, these are also to be included in the calculation of effective volume. Thus, the existing gas volume that is present in these, normally consisting of nitrogen gas, will be included in the calculation of the effective modulus of compressibility. It is appropriate in this case that the gas volumes of the accumulators when the impact mechanism is in its resting condition, i.e. the condition that normally prevails before the impact mechanism is started, be used. The said gas accumulators here are not to be confused with those that are normally connected to the supply line and return line for the impact mechanism. Such accumulators are connected to the drive chamber only intermittently, and are thus not to be included in the calculation of the effective volume or the effective modulus of compressibility.

Furthermore, E denotes the impact energy of the piston in its impact with the tool or with a part that interacts with the tool. Finally, p is the impact mechanism pressure that is used. The impact mechanism pressure is normally between 150 and 250 bar. Finally, k is a constant of proportionality, that it has become apparent most suitably lies in the interval $7.0 \leq k \leq 9.5$, but where a good effect for the efficiency can be achieved in the larger interval $6.2<k<11.0$ and even up to the interval 5.3-21.0.

When the volumes have been dimensioned according to the description above, it is possible to achieve an efficiency that exceeds 75% in the case in which the effective drive chamber volumes are limited by walls of non-flexible material, i.e. when the driving medium consists of pure fluid or fluid that has been mixed to a certain extent with gas while, in contrast, no gas accumulators are continuously directly connected to the drive chambers. It is possible to achieve such efficiencies without requiring extremely low play between the piston and the cylinder bore, and thus without the subsequent extremely high demands on manufacturing precision needing to be used. An appropriate play may be 0.05 millimeter. This form of impact mechanism is that which gives the longest service interval of all, since so few moving parts are included.

Very much smaller effective drive chamber volumes can be achieved if gas accumulators are continuously connected to the drive chambers and in this way are included in the calculation of effective volumes, as previously described. Furthermore, even higher efficiencies can be achieved in the impact mechanism if two gas accumulators with different specifications are connected to one and the same drive chamber in such a manner that one is pre-charged with a high gas pressure, i.e. equal to the impact mechanism pressure or the system pressure, and one is pre-charged with a low gas pressure, normally atmospheric pressure. When the dimensioning of volumes takes place as described earlier, an efficiency that exceeds 85% can be achieved with a play of the same magnitude as that previously mentioned. The service interval is increased also in this case, through the volumes not being made larger than necessary. The need for motion of the membrane of the accumulators can in this way be reduced.

One preferred embodiment constitutes an impact mechanism, where the volume (by which we refer to the effective volume as defined above) of one of the drive chambers is much larger than that of the second drive chamber, i.e. that the volume of the second drive chamber is negligible, for example 20% or less than the volume of the first drive chamber, and where the smaller drive chamber has essentially constant pressure during the complete stroke cycle. Constant pressure in this chamber is normally achieved by the chamber being connected to a source of constant pressure during the complete stroke cycle, or at least during essentially the complete stroke cycle, most often being directly connected to the source for the system pressure or alternatively impact mechanism pressure.

Impact mechanisms of the type that has been described above can be an integrated component of equipment for the machining of at least one of rock and concrete, such as rock drills and hydraulic breakers. These machines or breakers during operation should most often be mounted onto a carrier that can comprise means for their alignment and position together with means for the feed of the drill or breaker against the rock or concrete element that is to be machined, and further, means for the control and monitoring of the process. Such a carrier may be a rock drilling rig.

DETAILED DESCRIPTION OF PREFERRED EMBODIMENTS

A number of designs of the invention will be described as examples below, with reference to the attached drawings.

The protective scope of the invention is not to be regarded as limited to these embodiments, instead it is defined by the claims.

Figure 1:
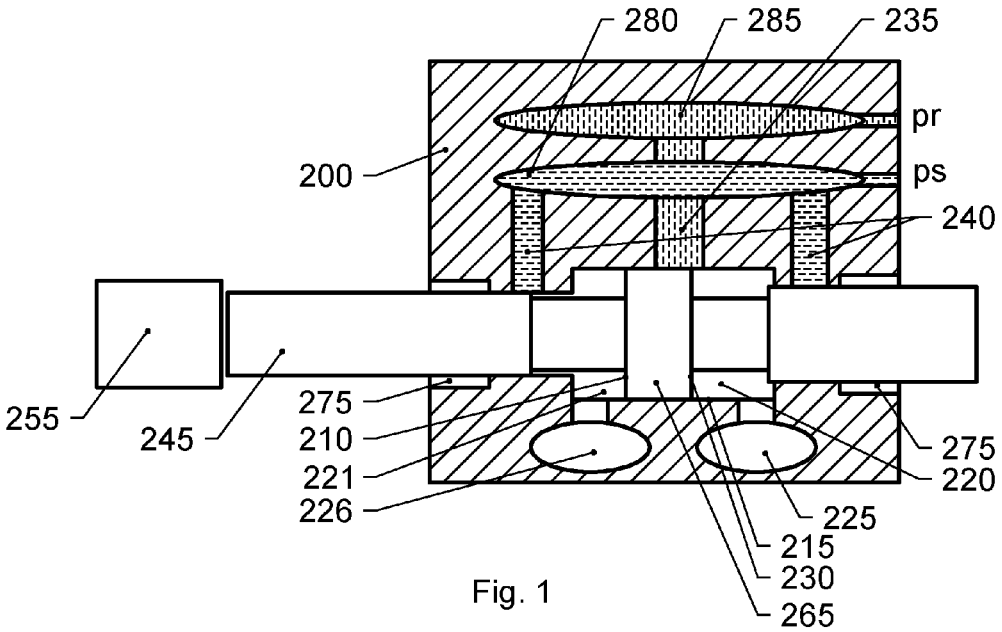
FIG. 1 shows a sketch of the principle of a valveless hydraulic impact mechanism with alternating pressure in drive chambers not only on the upper surface of the piston but also on its lower surface.

FIG. 1 shows schematically a hydraulic impact mechanism with alternating pressure not only on the upper surface of the piston but also on its lower surface.

Figure 2:
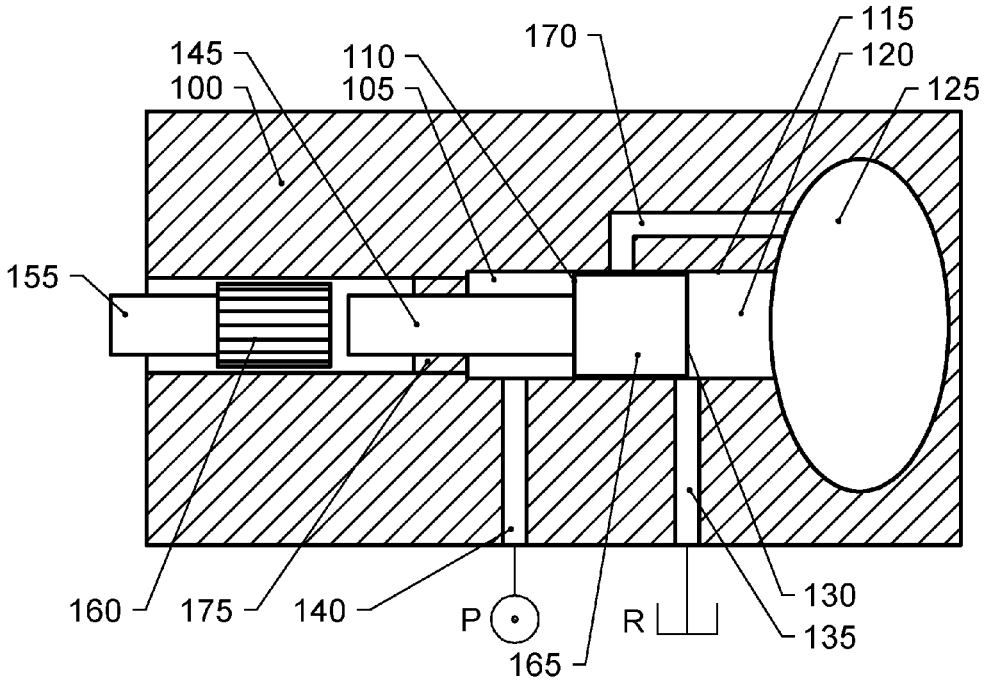
FIG. 2 shows a sketch of the principle for a corresponding impact mechanism with alternating pressure on only one surface, and with constant pressure on the second.

In a similar manner, FIG. 2 and FIG. 4 show an impact mechanism with constant hydraulic pressure throughout the stroke cycle on the lower surface of the piston, i.e. on that surface that is located most closely to the tool 155, 255 onto which the hammer piston is to transfer impact energy, and with alternating pressure during the stroke cycle on the upper surface of the piston.

Hydraulic fluid at impact mechanism pressure P is supplied to the impact mechanism through supply channels 140, 240, which pressure often lies within the interval 150-250 bar. The system pressure, i.e. the pressure that the hydraulic pump delivers, is often equal to the impact mechanism pressure.

The hydraulic fluid is set in connection with a hydraulic tank R through return channels 135, 235, in which tank the oil normally has atmospheric pressure.

The hammer piston 145, 245 executes a reciprocating motion in a cylinder bore 115, 215 in a machine housing 100, 200. The hammer piston comprises a driving part 165, 265 that separates a first driving area 130, 230 from a second driving area 110, 210. The pressure that acts on these driving areas causes the piston to execute reciprocating motion during operation. The piston is controlled radially by piston guides 175, 275. In order to avoid pulsation in connecting lines, gas accumulators 180, 280 and 185, 285 may be arranged on supply channels 140, 240 and return channels 135, 235, respectively, which gas accumulators even out rapid variations in pressure.

In order for it to be possible for the hammer piston 145, 245 to move sufficiently far into a drive chamber 120, 220, 221 with alternating pressure, with the aid of its kinetic energy, after the driving part 165, 265 has closed the connection to the return channel 135, 235, such that a connection between the supply channel 140, 240 and the chamber 120, 220, 221 can be opened, it is necessary that the chamber have a sufficiently large volume that the increase in pressure in the chamber as a consequence of the compression by the piston of the volume of fluid that has now been enclosed within the chamber is not so large that the piston reverses its direction before a supply channel 140, 240 has been opened into the chamber, such that the pressure can now rise to the full impact mechanism pressure, and the piston in this way be driven in the opposite direction. The drive chamber for this purpose is connected to a working volume 125, 225, 226. Since this connection between the drive chamber and the working volume is maintained throughout the stroke cycle, we will denote the sum of the volume of the drive chamber and the working volume as the "effective drive chamber volume". It has proved to be the case, as has been described earlier in this application, that this volume is critically important to achieving high efficiency.

A functioning design involves an effective volume of 3 liters for a system pressure of 250 bar, impact energy of 200 Joules, a hammer piston weight of 5 kg, an area of the first drive surface 130 of 16.5 $cm^2$ and an area of the second drive surface 110 of 6.4 $cm^2$. The length of the driving part 70 mm and the distance between the supply channel and the return channel for the drive chamber 120 at their relevant connections to the cylinder bore is 45 mm.

Figure 3:
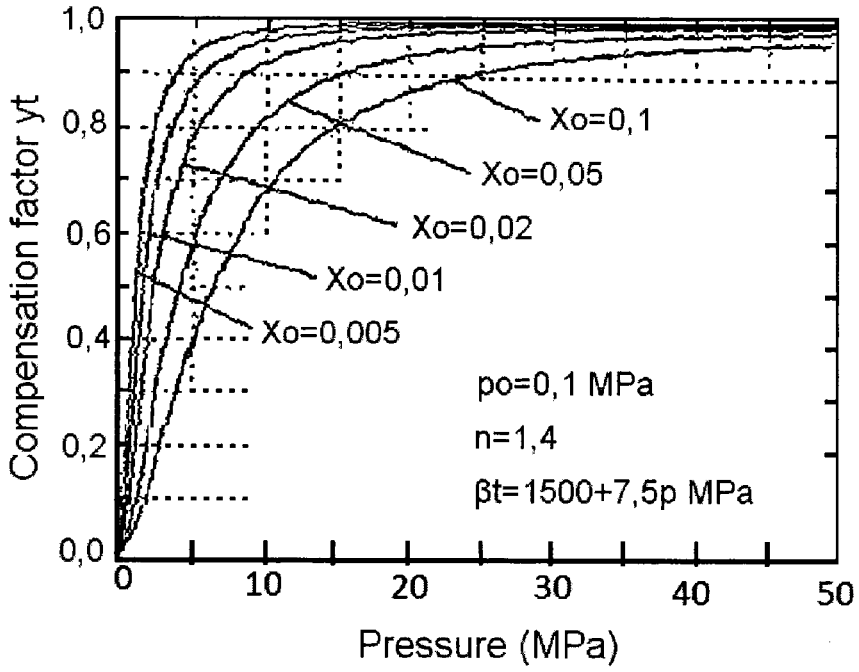
FIG. 3 shows a diagram, actually known, for the calculation of the effective modulus of compressibility for a pressure medium that consists of gas and hydraulic fluid.
Figure 4A:
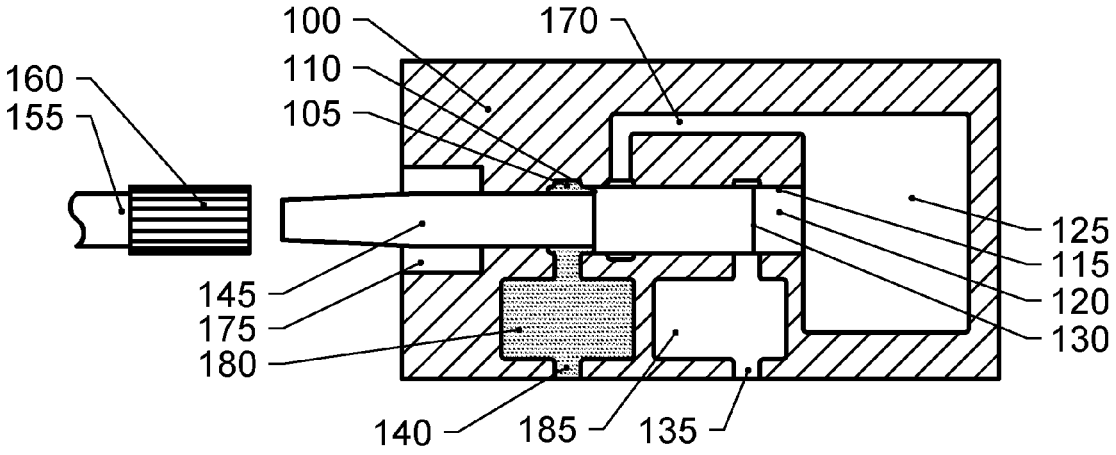
FIG. 4 shows an impact mechanism according to FIG. 2 with the hammer piston at four different positions: A—the braking is starting at the upper position; B—the upper turning point; C—the braking is starting at the lower position; D—the lower turning point.
Figure 4B:
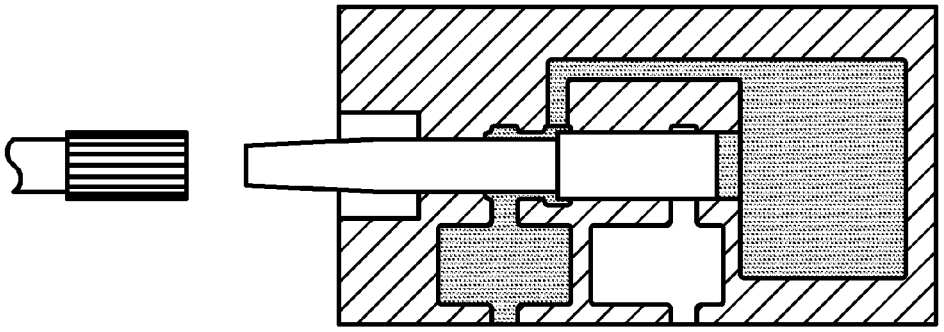
Figure 4C:
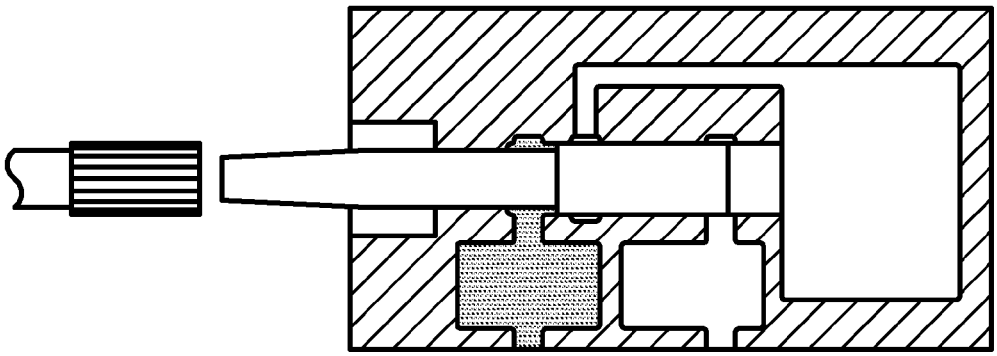
Figure 4D:
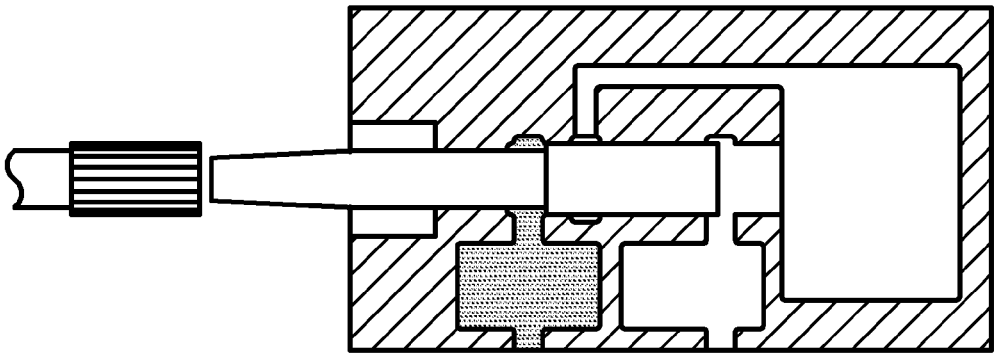

At an impact mechanism pressure or system pressure of 250 bar, giving a β value, as is made clear by FIG. 3, equal to 1500+7.5×25=1687.5 MPa. These values together with an effective volume of 3 liters and impact energy of 200 Joule give, as an example, the constant of proportionality:

$$k=(3\cdot10^{-3}/200\cdot1687.5\cdot10^{6})\cdot(250\cdot10^{5})^{2}=5.55.$$

The drive chamber volume and, in particular, the working volume with its large volume can be located in the machine housing in various ways.

It is advantageous that the volumes be placed symmetrically around the cylinder bore.

It is further advantageous that they be placed concentrically around the cylinder bore.

It may be advantageous, as an alternative, that they be placed in the extension of the cylinder bore.

It is appropriate that an impact mechanism according to the principles described above be integrated in a rock drill or, alternatively, in a hydraulic breaker.

A rock drilling rig with equipment for the positioning and alignment of such a rock drill or hydraulic breaker should comprise at least one rock drill or at least one hydraulic breaker according to the invention.

The invention claimed is:

1. A valveless hydraulic impact mechanism for use in equipment for at least one of rock and concrete machining, said valveless hydraulic impact mechanism comprising a machine housing with a cylinder bore, a piston mounted to move within the cylinder bore and arranged to carry out repetitively reciprocating motion relative to the machine housing during operation, said reciprocating motion delivering impacts directly or indirectly onto a tool connectable to the equipment for machining at least one of rock and concrete, a driving medium at a predetermined impact mechanism pressure p, and wherein the piston includes a driving part that separates a first and a second drive chamber formed between the piston and the machine housing, and wherein the first and second drive chambers are arranged such that they include during operation the driving medium under pressure, and wherein the machine housing further includes channels that open out into the cylinder bore and are arranged such that the channels include the driving medium during operation, and that with the aid of the piston, during said reciprocating motion in the cylinder bore, the channels open onto and close from one of the first and second drive chambers such that said one of said first and second drive chambers acquires a periodically alternating pressure for maintaining the reciprocating motion of the piston, and that positions for the opening of the channels axially in the cylinder bore and for opening and closing of the channels along parts of the piston are adapted to maintain said one of said first and second drive chambers closed for the supply or drainage of the driving medium that is present in the one of said first and second drive chambers along a distance between an opening of a first said channel associated with a first turning point of the piston and an opening of a second said channel associated with a second turning point of the piston, and that the motion of the piston along said distance continues during the compression or expansion of the volume of said one of said first and second drive chambers, wherein said volume has been further adapted in order to achieve a predetermined change in pressure along the said distance, wherein the total volume V of the first and second drive chambers, including volumes that are in continuous connection with one and the same drive chamber during a complete cycle of a stroke, has been dimensioned to be inversely proportional to the square of the impact mechanism pressure p, and further proportional, with a constant of proportionality k, that has a value in the interval 5.3-21.0, to the product of the energy E of the piston in the impact against the tool and the modulus of compressibility β of the driving medium, according to the equation $V=k*\beta*E/p^2$.

2. The hydraulic impact mechanism according to claim 1, with the constant of proportionality k in the interval $6.2<k<11$.

3. The hydraulic impact mechanism according to claim 2, where the volume of one of the first and second drive chambers is greater than the volume of the other of said first and second drive chambers.

4. The hydraulic impact mechanism according to claim 2, where one of the drive chambers has a constant pressure during the complete stroke cycle.

5. The hydraulic impact mechanism according to claim 2, where one of said first and second drive chambers are alternately set under pressure.

6. The hydraulic impact mechanism according to claim 2, where the volumes of the chambers extend symmetrically around the cylinder bore.

7. The hydraulic impact mechanism according to claim 2, where the volumes of the chambers extend concentrically around the cylinder bore.

8. The hydraulic impact mechanism according to claim 1, with the constant of proportionality k in the interval $7.0<k<9.5$.

9. The hydraulic impact mechanism according to claim 8, where the volume of one of the first and second drive chambers is greater than the volume of the other of said first and second drive chambers.

10. The hydraulic impact mechanism according to claim 8, where one of the drive chambers has a constant pressure during the complete stroke cycle.

11. The hydraulic impact mechanism according to claim 8, where one of said first and second drive chambers are alternately set under pressure.

12. The hydraulic impact mechanism according to claim 1, where the volume of one of the first and second drive chambers is greater than the volume of the other of said first and second drive chambers.

13. The hydraulic impact mechanism according to claim 1, where one of the drive chambers has a constant pressure during the complete stroke cycle.

14. The hydraulic impact mechanism according to claim 13, where the drive chamber with alternating pressure extends into the cylinder bore.

15. The hydraulic impact mechanism according to claim 1, where one of said first and second drive chambers are alternately set under pressure.

16. The hydraulic impact mechanism according to claim 1, where the volumes of the chambers extend symmetrically around the cylinder bore.

17. The hydraulic impact mechanism according to claim 1, where the volumes of the chambers extend concentrically around the cylinder bore.

18. A rock drill comprising impact mechanisms according to claim 1.

19. A rock drilling rig comprising the rock drill according to claim 18.

20. A hydraulic breaker comprising impact mechanisms according to claim 1.

* * * * *